US009416569B1

(12) United States Patent
Leone et al.

(10) Patent No.: US 9,416,569 B1
(45) Date of Patent: Aug. 16, 2016

(54) LATCH ASSEMBLY

(71) Applicant: The Boeing Company, Chicago, IL (US)

(72) Inventors: Cristiano Leone, Bothell, WA (US); Wayne Howard Peterson, Bothell, WA (US); James Paul Hacault, Winnipeg (CA)

(73) Assignee: THE BOEING COMPANY, Chicago, IL (US)

( * ) Notice: Subject to any disclaimer, the term of this patent is extended or adjusted under 35 U.S.C. 154(b) by 260 days.

(21) Appl. No.: 13/972,380

(22) Filed: Aug. 21, 2013

(51) Int. Cl.
*E05C 5/04* (2006.01)

(52) U.S. Cl.
CPC ..... *E05C 5/04* (2013.01)

(58) Field of Classification Search
CPC ..... E05C 5/04; E05C 5/02
See application file for complete search history.

(56) References Cited

U.S. PATENT DOCUMENTS 2,136,408 A * 11/1938 Bedell ..... E05C 5/04 292/198
5,280,973 A * 1/1994 Culling ..... E05B 17/0025 292/342
8,419,088 B2 * 4/2013 Baic ..... E05C 3/06 292/194
2012/0111069 A1 * 5/2012 Padjen ..... E05C 5/04 70/91

FOREIGN PATENT DOCUMENTS

EP 0623720 A1 9/1994

* cited by examiner

*Primary Examiner* — Kristina Fulton
*Assistant Examiner* — Thomas Neubauer
(74) *Attorney, Agent, or Firm* — Thompson Hine LLP

(57) ABSTRACT

A latch assembly may be configured for use with a first structure having an outer surface and a second structure that is movable relative to the first structure. The latch assembly may include a latch member and a visual indicator device. The latch member may be movable into and out of a latching position securing the second structure to the first structure. The visual indicator device may be movable between a retracted position not protruding outward from the outer surface of the first structure and an extended position protruding outward from the outer surface. A linkage may be operatively connected between the latch member and the visual indicator device to move the visual indicator device from the retracted position to the extended position under the influence of the latch member when the latch member is moved out of the latching position.

17 Claims, 8 Drawing Sheets

LATCH ASSEMBLY

TECHNICAL FIELD

The present disclosure relates to a latch assembly, and more particularly, to a latch assembly for an access panel on an aircraft body.

BACKGROUND

An aircraft body has access panels that serve as doors providing access to internal compartments. For example, a forward access panel is a tool-operated, inwardly opening plug type door that provides access to the equipment bay located in the nose of the aircraft. Other examples include access panels at the wing to fairing structure and other locations on the aircraft body. In each case the access panel has one or more latch assemblies. Such a latch assembly includes a latch member that is movable into and out of a latching position securing the access panel in a closed position. The latch member is located at the inside of the access panel, and is not visible from the outside of the aircraft.

SUMMARY

In an embodiment, a latch assembly may be configured for use with a first structure having an outer surface and a second structure that is movable relative to the first structure. The latch assembly may include a latch member and a visual indicator device. The latch member may be movable into and out of a latching position securing the second structure to the first structure. The visual indicator device may be movable between a retracted position not protruding outward from the outer surface of the first structure and an extended position protruding outward from the outer surface. A linkage may be operatively connected between the latch member and the visual indicator device to move the visual indicator device from the retracted position to the extended position under the influence of the latch member when the latch member is moved out of the latching position.

In another embodiment a vehicle, such as an aircraft, may have a first body panel with an outer surface and a second body panel that is movable relative to the first body panel. A latch member may be movable pivotally into and out of a latching position securing the second body panel to the first body panel. A visual indicator device may have a longitudinal axis, and may be movable longitudinally between a retracted position not protruding outward from the outer surface of the first body panel and an extended position protruding outward from the outer surface. A mechanism may include a helical cam and a cam follower. The cam follower may be engaged between the latch member and the indicator device to move the indicator device longitudinally upon movement of the latch member pivotally, whereby the mechanism can move the indicator device between the retracted and extended positions upon movement of the latch member into and out of the latching position.

In yet another embodiment, a method for indicating an unlatched condition of first and second structures that are movable relative to one another may include moving a latch member out of a latching position securing the structures together, and moving a visual indicator device under the influence of the latch member. The visual indicator device may be moved relative to an outer surface of the first structure from a non-protruding position to a protruding position under the influence of the latch member when the latch member is moved out of the latching position.

Other objects and advantages of the disclosed latch assembly for aircraft access panel will be apparent from the following description, the accompanying drawings and the appended claims.

DETAILED DESCRIPTION

Figure 1:
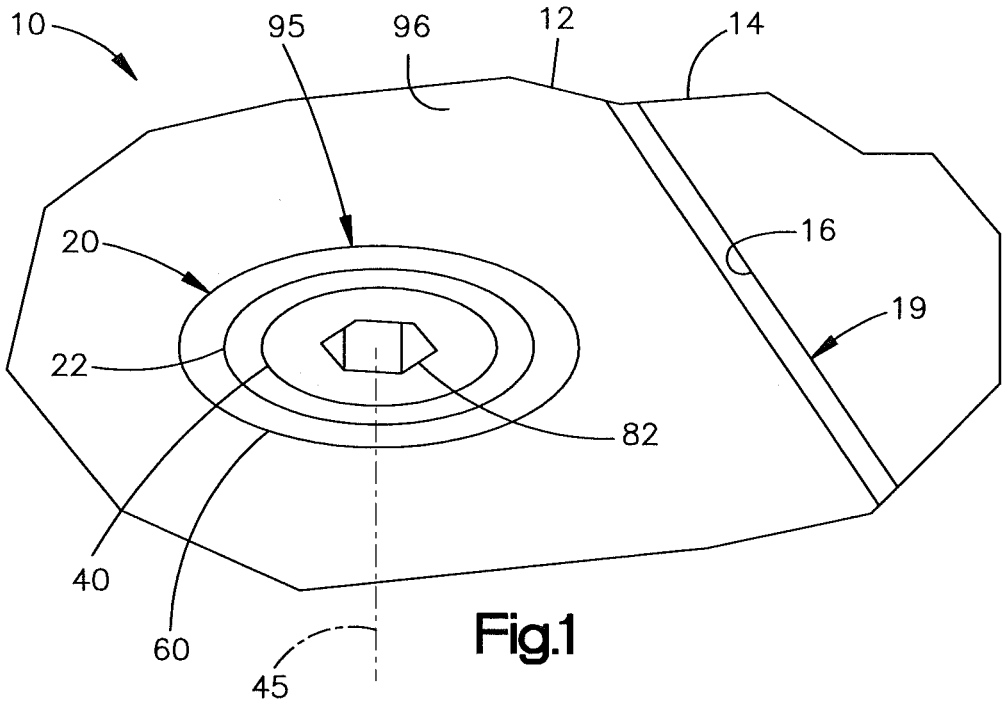
FIG. 1 is a perspective view of an embodiment of the disclosed latch assembly, shown mounted on an aircraft access door panel, taken from outside the aircraft body.

As partially shown in FIG. 1, a vehicle body 10 may include first and second relatively movable structures 12 and 14. The first structure 12 in this example may include a door panel, and the second structure 14 in this example may include a panel surround 14. An edge 16 of the panel surround 14 may define an opening 19 in which the door panel 12 may be received in the closed position of FIG. 1. The vehicle may be, for example, an aircraft, a spacecraft, a land vehicle or a marine vehicle. On an aircraft body, the door panel 12 may be a forward access panel any other suitable door panel that is mounted on hinges or otherwise supported for movement relative to the respective panel surround 14.

Figure 2:
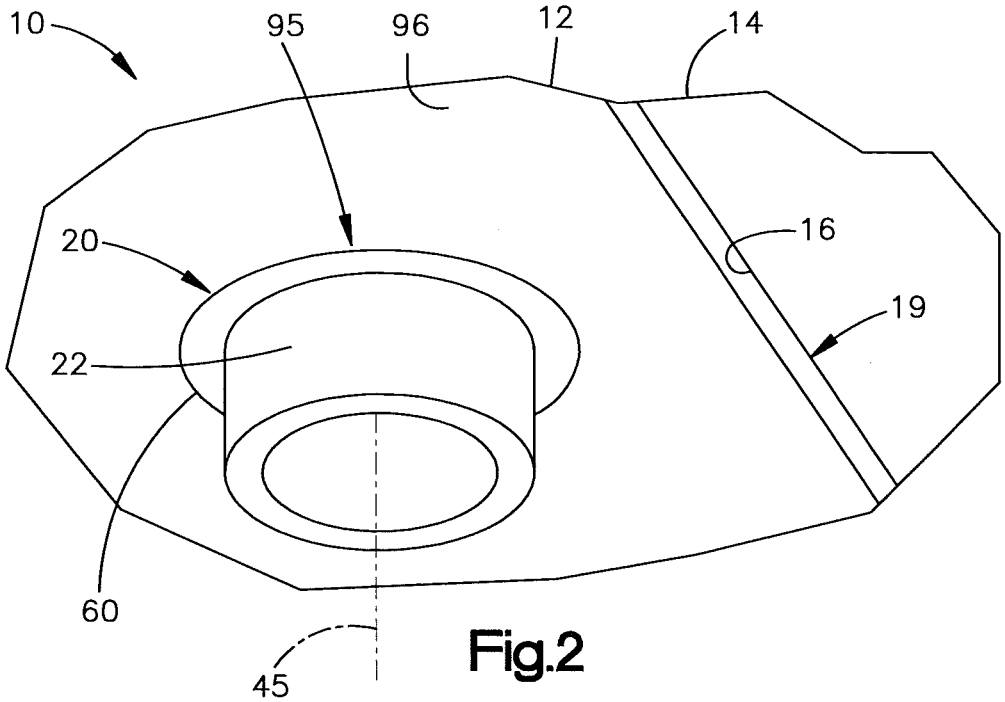
FIG. 2 is a perspective view of the embodiment of FIG. 1, showing the latch assembly in unlatched position.

A latch assembly 20 beside the opening 19 operates to latch the door panel 12 securely in the closed position, and to unlatch the door panel 12 for movement inward from the opening 19. When the latch assembly 20 unlatches the door panel 12 from the panel surround 14, a visual indicator device 22 moves from the recessed position of FIG. 1 to the extended position of FIG. 2. This provides a visual indication that the door panel 12, although still located in the closed position in the opening 19, is not secured by the latch assembly 20.

Figure 3:
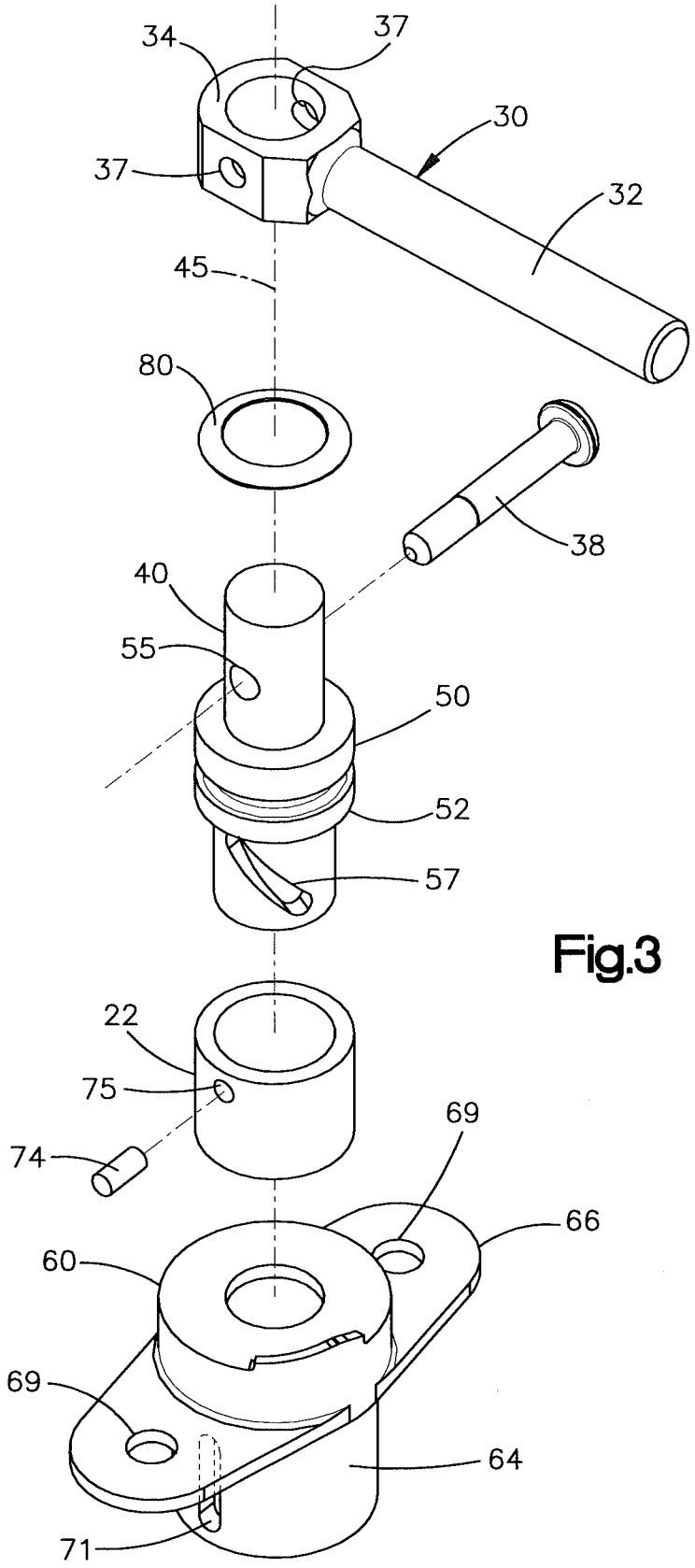
FIG. 3 is an exploded, perspective view of the embodiment of FIG. 1.

As shown in FIG. 3, this embodiment of the latch assembly 20 has parts including a latch member in the form of a latch pin 30. The latch pin 30 may have an elongated cylindrical rod 32 projecting from a ring-shaped head 34. The head 34 may have apertures 37 for receiving a fastener 38.

The parts shown in FIG. 3 further include a shaft 40 with a cylindrical shape centered on an axis 45. A pair of flanges 50 and 52 may be spaced apart along the axis 45. A passage 55 for the fastener 38 may extend transversely through the shaft 40 above the flanges 50 and 52 for attachment of the latch pin 30 to the shaft 40. A helical slot 57 may extend partially along the length of the shaft 40 beneath the flanges 50 and 52.

As further shown in FIG. 3, other parts of the latch assembly 20 in this embodiment include a body 60 and the visual indicator device 22. The visual indicator device 22 may be a sleeve that fits over the shaft 40 beneath the flanges 50 and 52. The body 60 may have a cylindrical portion 64, and may include a mounting plate 66 with fastener openings 69. An axially extending slot 71 may reach partly along the length of the cylindrical portion 64.

When the parts shown in FIG. 3 are interconnected in the latch assembly 20, the sleeve 22 and the shaft 40 are received coaxially within the cylindrical portion 64 of the body 60. A pin 74 may extend through an aperture 75 in the sleeve 22. The pin 74 may project radially inward from the sleeve 22 into the helical slot 57 on the shaft 40. The pin 74 may also project radially outward from the sleeve 22 into the axially extending slot 71 on the body 60.

Figure 4:
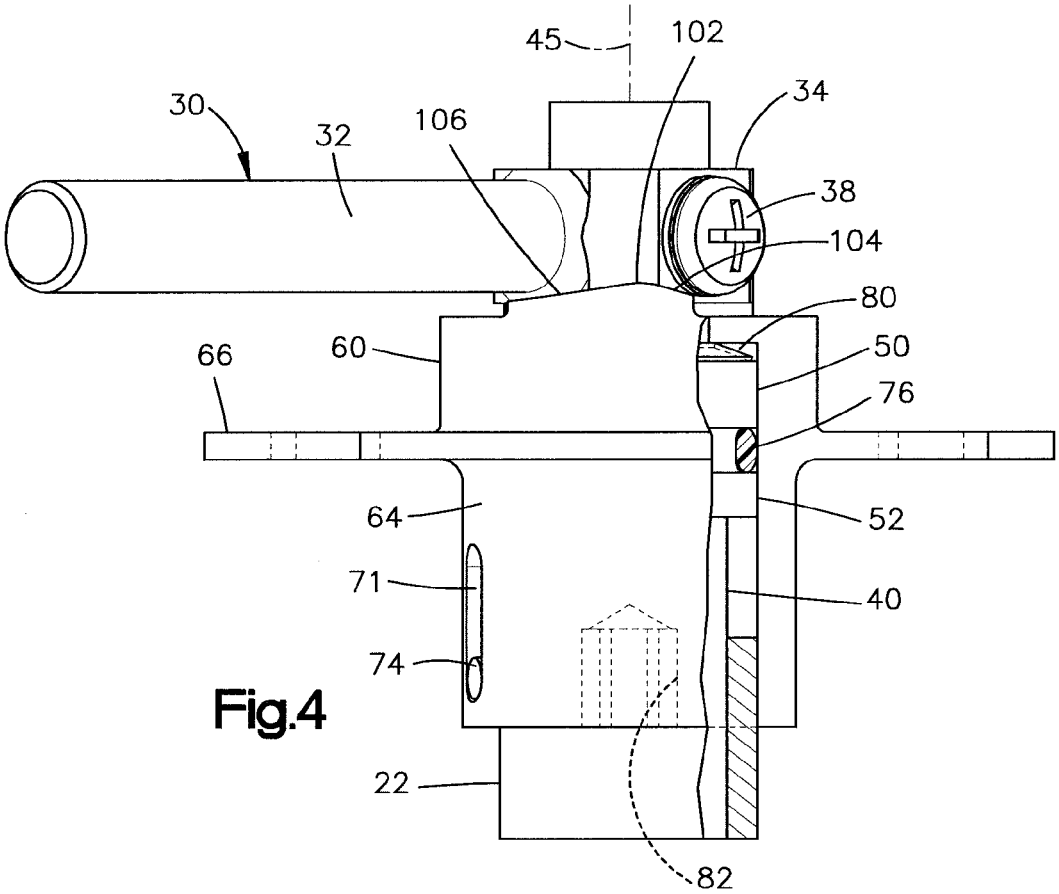
FIG. 4 is a side view, partly in section, of the embodiment of FIG. 1, showing the latch assembly in unlatched position.
Figure 5:
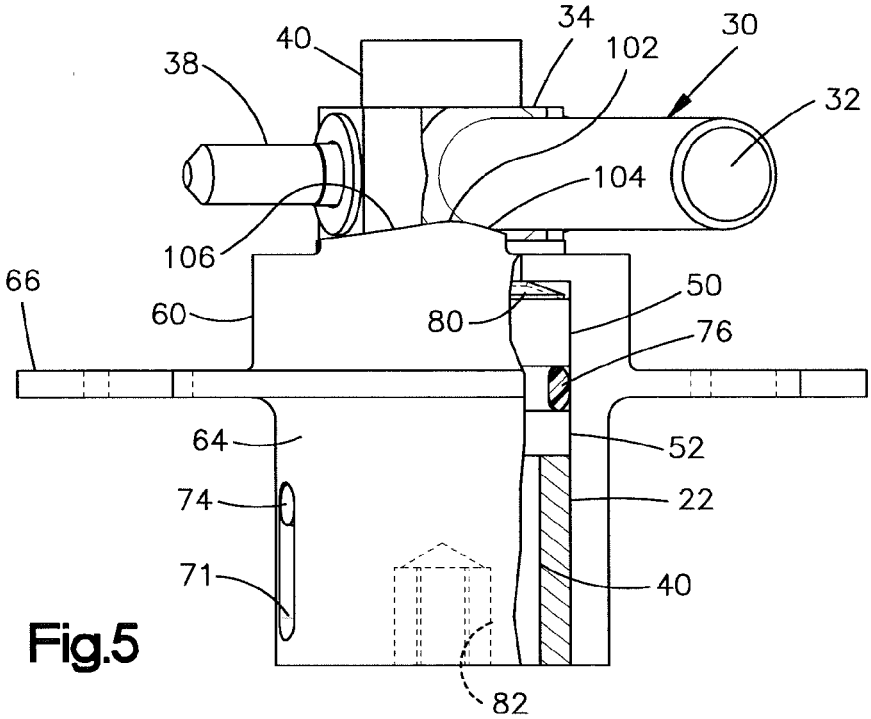
FIG. 5 is a view similar to FIG. 4, showing parts in latched position.

More specifically, the parts shown in FIG. 3 are interconnected as shown in FIGS. 4 and 5. An O-ring 76 may be received between the flanges 50 and 52 to provide a seal between the shaft 40 and the body 60. A spring washer 80 may be received axially between the first flange 50 and the body 60. A tool engagement feature 82 at the end of the shaft 40 can receive a driving tool for the user to rotate the shaft 40 about the axis 45. In this manner the user can move the latch pin 30, which in the illustrated embodiment is fixed to the shaft 40, pivotally about the axis 45 between a unlatched position, as shown in FIG. 4, and a latching position, as shown in FIG. 5.

When the user rotates the shaft 40 to move the latch pin 30 pivotally, the shaft 40 rotates relative to the body 60, but the pin 74 in the slot 71 blocks the sleeve 22 from rotating relative to the body 60. The helical groove 57 then acts as a cam, with the pin 74 acting as a cam follower, to drive the sleeve 22 along the axis 45 as the shaft 40 rotates about the axis 45. The shaft 40, the pin 74, and the body 60 in the illustrated embodiment thus act together as a linkage mechanism that moves the sleeve 22 along the axis 45 as the latch pin 30 moves pivotally about the axis 45. When the latch pin 30 is moved back and forth between the latching position of FIG. 5 and the unlatched position of FIG. 4, the sleeve 22 is moved longitudinally back and forth between a retracted position received fully within the body 60 (FIG. 5) and an extended position projecting outward from the body 60 (FIG. 4).

Figure 6:
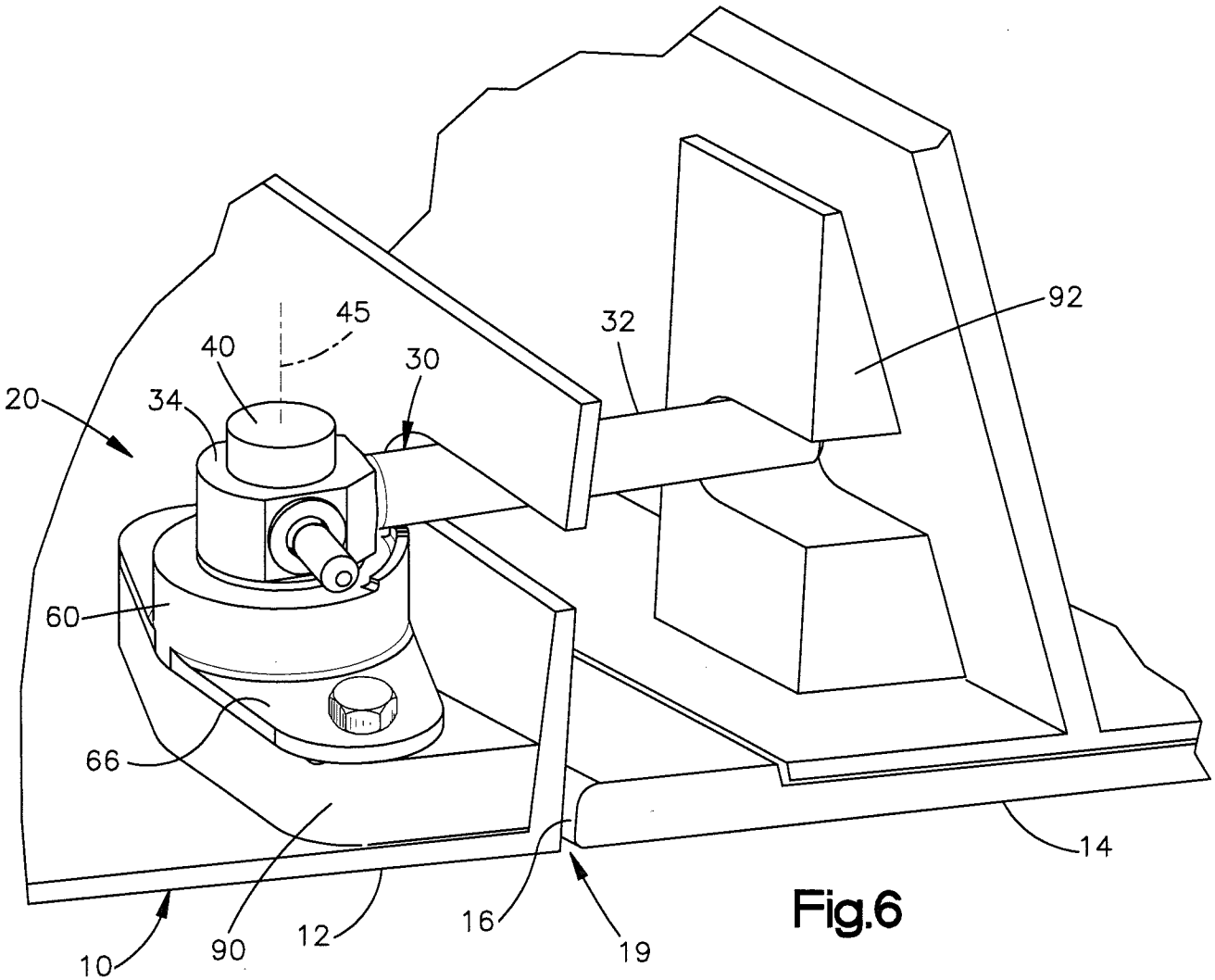
FIG. 6 is a perspective view of the embodiment of FIG. 1, taken from inside the aircraft body.

Referring again to FIGS. 1 and 2, the latch assembly 20 in this embodiment may be mounted on the door panel 12. One or more additional latch assemblies 20 may also be mounted on the door panel 12. As shown in greater detail in FIG. 6, the body 60 of each latch assembly 20 may be fastened to a mounting boss 90 at the inside of the door panel 12. The latch pin 30 in each latch assembly 20, when in the latching position as shown in FIG. 6, may engage a bracket 92 on the panel surround 14 to secure the door panel 12 to the panel surround 14, but the latch pin 30 is not visible from outside of the vehicle body 10.

In each latch assembly 20, the cylindrical portion 64 of the body 60 may fit closely into an aperture 95 in the door panel 12 as shown in FIG. 1, and may be flush with, or recessed from, the adjacent outer surface 96 of the door panel 12. The shaft 40 is preferably perpendicular to the plane of the outer surface 96 at the aperture 95. The tool engagement feature 82 at the end of the shaft 40 may be accessible in the aperture 95, and also may be flush or recessed at the outer surface 96 so as not to protrude outward. Preferably, the sleeve 22 also does not protrude from the outer surface 96 of the door panel 12 when in the retracted position shown in FIG. 1. However, the sleeve 22 is moved outward through the aperture 95 to protrude from the outer surface 96 when moved to the extended position of FIG. 2. In this manner the sleeve 22 provides a visual indication that the latch pin 30 has been moved out of the latching position. Return movement of the sleeve 22 inward through the aperture 95 to the recessed position of FIG. 1 provides a corresponding visual indication that the latch pin 30 has been moved back to the latching position.

An additional feature of the latch assembly 20 is a spring-biased over-center mechanism that acts between the latch pin 30 and the shaft 40. As shown in FIGS. 4 and 5, the body 60 may have a cam profile with a center point 102 between two ramp surfaces 104 and 106. As the latch pin 30 begins to move from the latching position toward the unlatched position, the rod 32 may slide upward along the first ramp surface 104 toward the center point 102. This lifts the shaft 40 such that the upper flange 50 on the shaft 40 presses the spring washer 80 upward against the body 60. The resulting stress in the spring washer 80 provides resistance that biases the rod 32 back down the ramp surface 106 toward the latching position. A reversed over-center effect biases the rod 32 toward the unlatched position when the rod 32 is located on the second ramp surface 104 at the other side of the center point 102.

Figure 7:
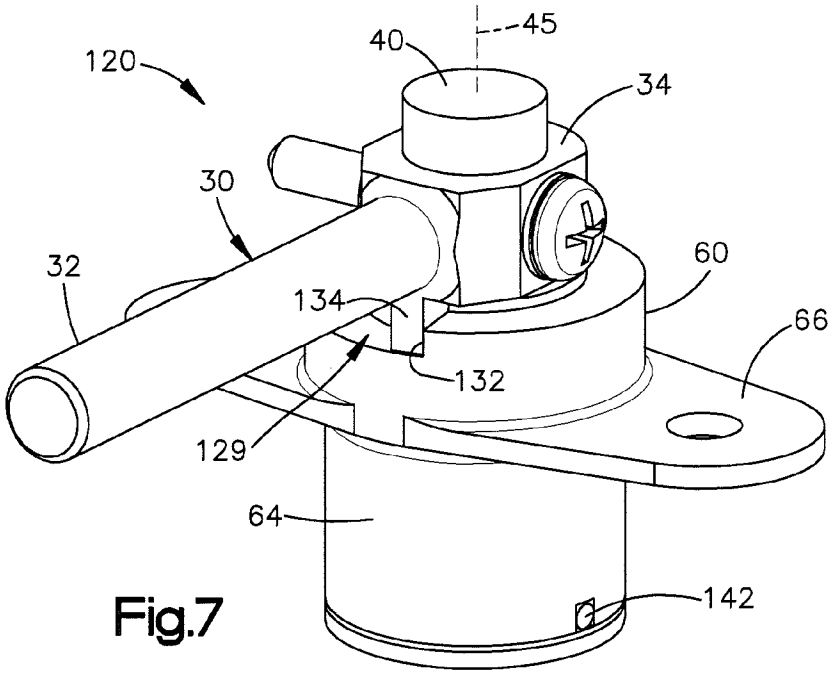
FIG. 7 is a perspective view of another embodiment of the disclosed latch assembly.

Another embodiment of a latch assembly 120 is shown in FIG. 7. This latch assembly 120 may have many parts that are the same or substantially the same as corresponding parts of the latch assembly 20 described above, as indicated by the use of the same reference numbers for such parts in the drawings. However, the latch assembly 120 differs from the latch assembly 20 by omitting the visual indicator device 22, and by including a motion limiting structure and a torsion spring 124.

Figure 8:
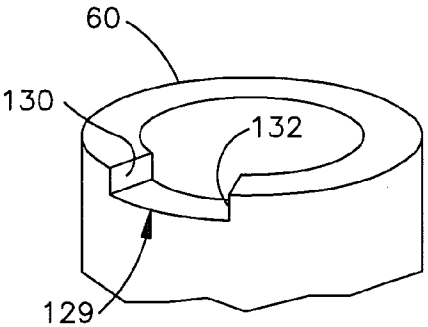
FIG. 8 is a perspective view of the motion limiting feature detail of the embodiment of FIG. 7.

As best shown in FIG. 8, the motion limiting structure may provide a circumferentially extending slot 129 at the inner end of the body 60. Stop surfaces 130 and 132 may be located at opposite ends of the slot 129. A stop member 134 (FIG. 8) on the head 34 of the latch pin 30 may extend into the slot 129 for movement circumferentially throughout a range defined between the stop surfaces 130 and 132 at the opposite ends of the slot 129.

Figure 9:
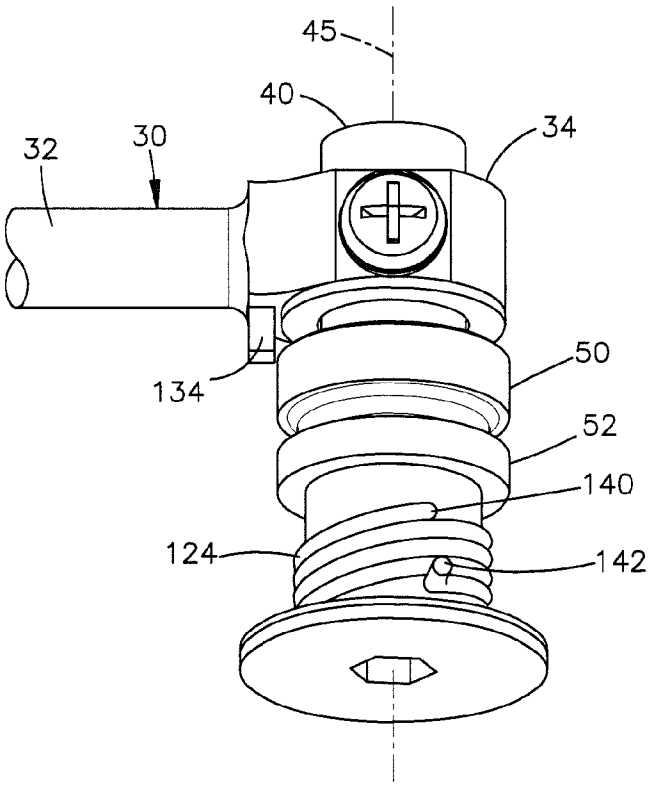
FIG. 9 is a perspective view of other parts of the embodiment of FIG. 7.

A first end 140 of the torsion spring 124 may engage the shaft 40, as shown in FIG. 9. A second end 142 of the torsion spring 124 may engage the cylindrical portion 64 of the body 60, as shown in FIG. 7. In the assembled condition of FIG. 7, the stop member 134 on the latch pin 30 abuts the second stop surface 132 in the slot 129. The torsion spring 124, which may be either stressed or unstressed in the condition of FIG. 7, can then apply a spring force resisting rotation of the shaft 40 about the axis 45 upon movement of the stop member 134 away from the second stop surface 132.

When this embodiment of a latch assembly 120 is mounted a door panel 12 as described above with reference to FIG. 6, it is placed such that the latch pin 30 takes its latched position in the condition of FIG. 7. The torsion spring 124 can then apply the spring force to resist movement of the latch pin 30 pivotally out of the latching position, and to bias the latch pin 30 back toward the latching position.

Figure 10:
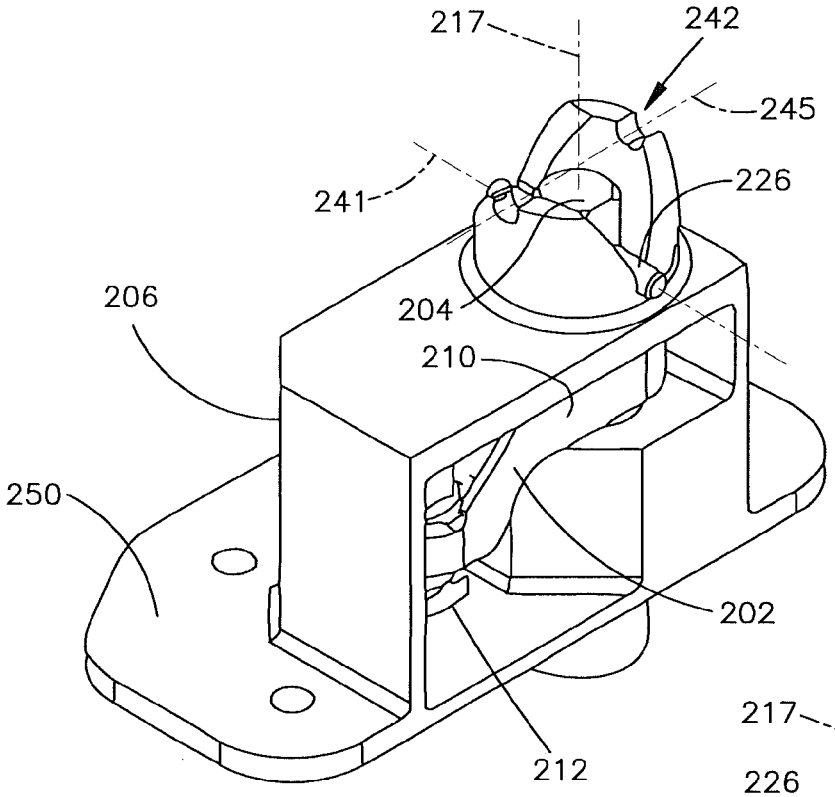
FIG. 10 is a perspective view of yet another embodiment of the disclosed latch assembly.

Yet another embodiment of a latch assembly 200 is shown in FIG. 10. This latch assembly 200 may include a latch member 202, a shaft 204, and a body 206.

Figure 11:
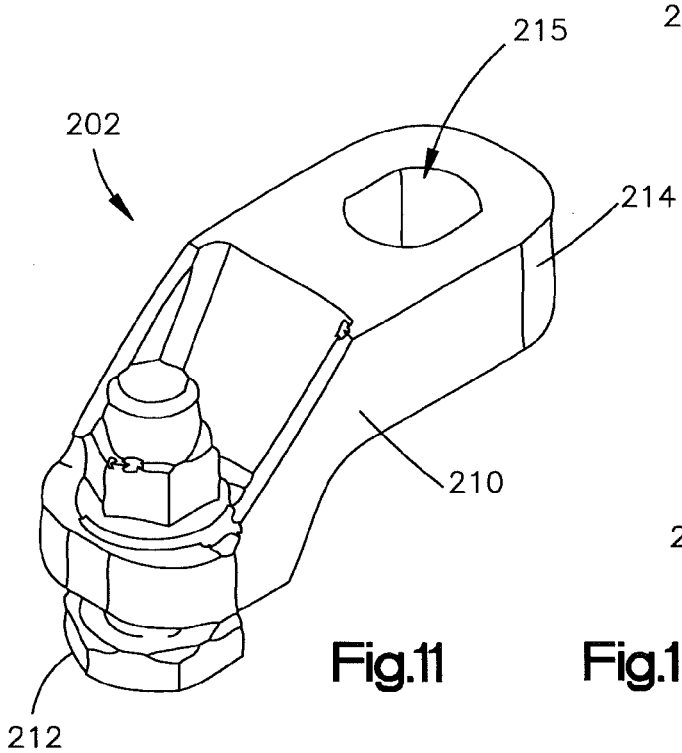
FIG. 11 is a perspective view of a part of the embodiment of FIG. 10.
Figure 12:
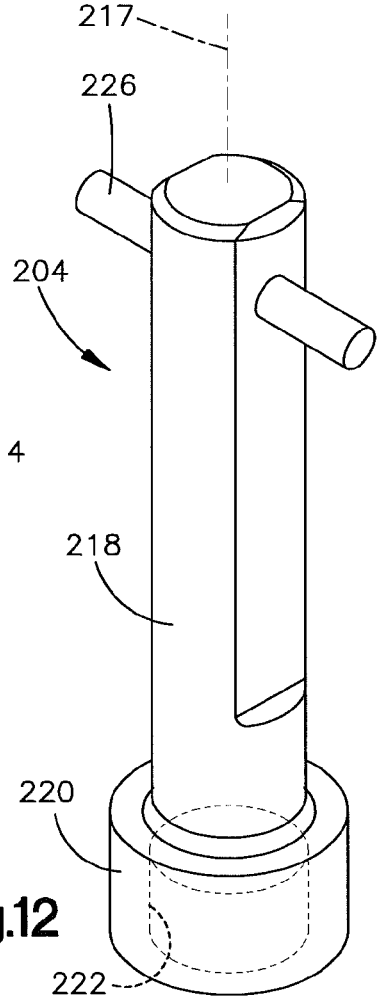
FIG. 12 is a perspective view of another part of the embodiment of FIG. 10.

The latch member 202 (FIG. 11) may include an arm 210 and a bolt 212. An end portion 214 of the arm 210 may have a bore 215 with a non-circular cross section. The shaft 204 (FIG. 12), which may have a longitudinal central axis 217, may have a major portion 218 with a non-circular cross section, and may further have a cylindrical head 220 with a tool engagement feature 222 at the outer end. A locator pin 226 may extend transversely through the major portion 218 near the inner end.

Figure 13:
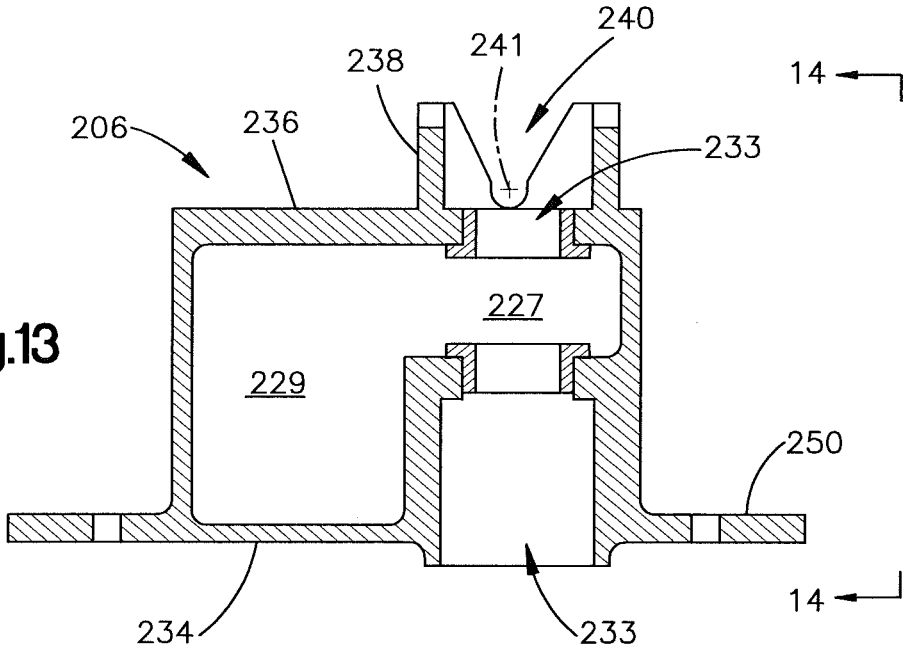
FIG. 13 is a sectional view of a part of the embodiment of FIG. 10.
Figure 14:
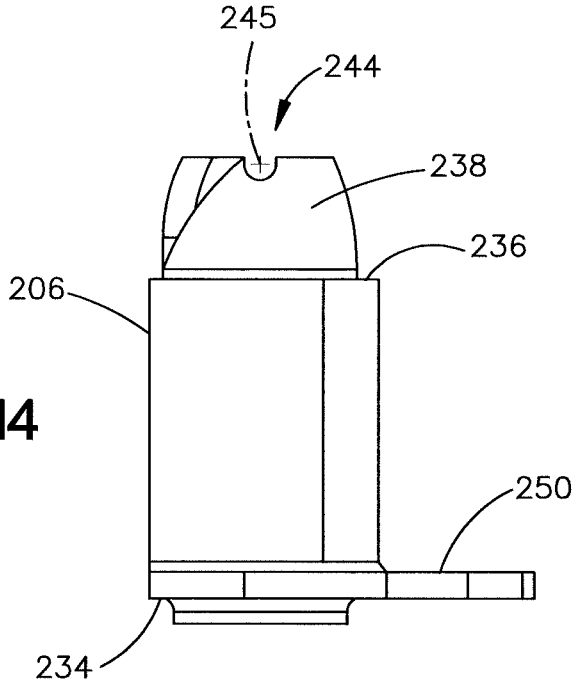
FIG. 14 is a side view of the part shown in FIG. 13.

The body 206 (FIGS. 13 and 14) may have first and second compartments 227 and 229, both of which are open at opposite sides of the body 206. A pair of passages 233 may communicate the first compartment 227 with the inner and outer ends 234 and 236 of the body 206. A locator structure 238 at the inner end 234 may have a first pair of notches 240 on a first transverse axis 241, and a second pair of notches 244 on a second transverse axis 245. The second transverse axis 245 may be perpendicular to the first transverse axis 241, and may be spaced inward from the first transverse axis 241.

Figure 15:
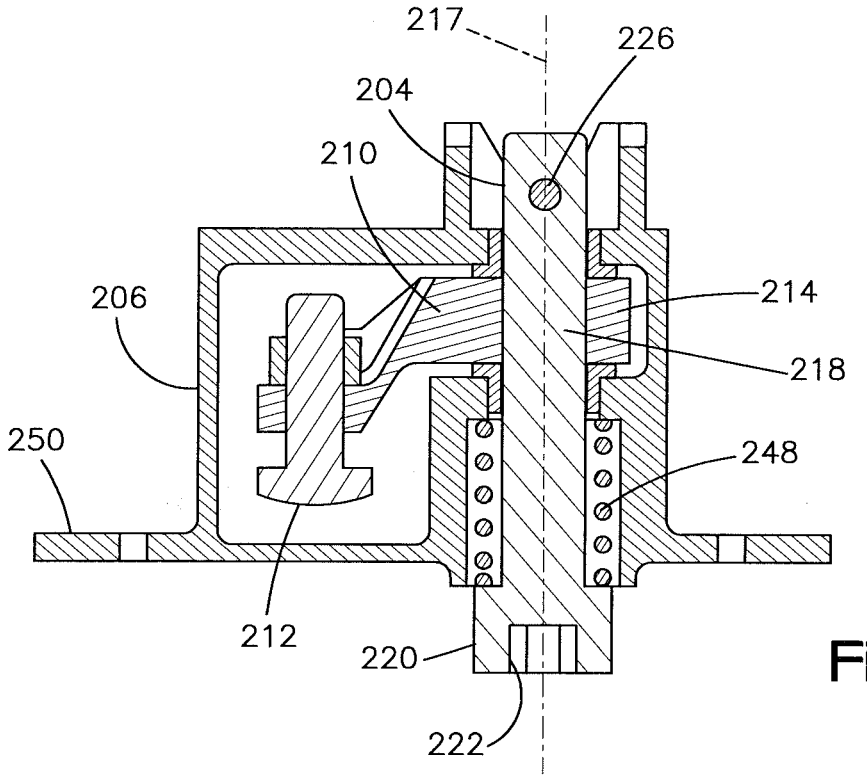
FIG. 15 is a sectional view showing interconnected parts of the embodiment of FIG. 10.

As shown in FIG. 15, the end portion 214 of the arm 210 may be received in the first compartment 227 in the body 206. The major portion 218 of the shaft 204 may extend through the bore 215 in the arm 210, and may project through the passages 233. In this arrangement, the shaft 204 may carry the arm 210 pivotally about the axis 217 when the shaft 204 rotates about the axis 217 relative to the body 206. The shaft 204 may also be movable along the axis 217 relative to both the arm 210 and the body 206. A spring 248 may be compressed between the body 206 and the head 220 to bias the shaft 204 outward along the axis 217.

In use, a mounting flange 250 on the body 206 may be fastened to a mounting boss on the inside of an aircraft panel structure beside an opening for an access door panel. In a fully unlatched position, as shown in FIGS. 10 and 15, the latch member 202 may be contained within the body 206. The locator pin 226 on the shaft 204 may then rest in the first notches 240 on the body 206. The head 220 of the shaft 204 may then project longitudinally outward from the body 206 along the axis 217.

Figure 16:
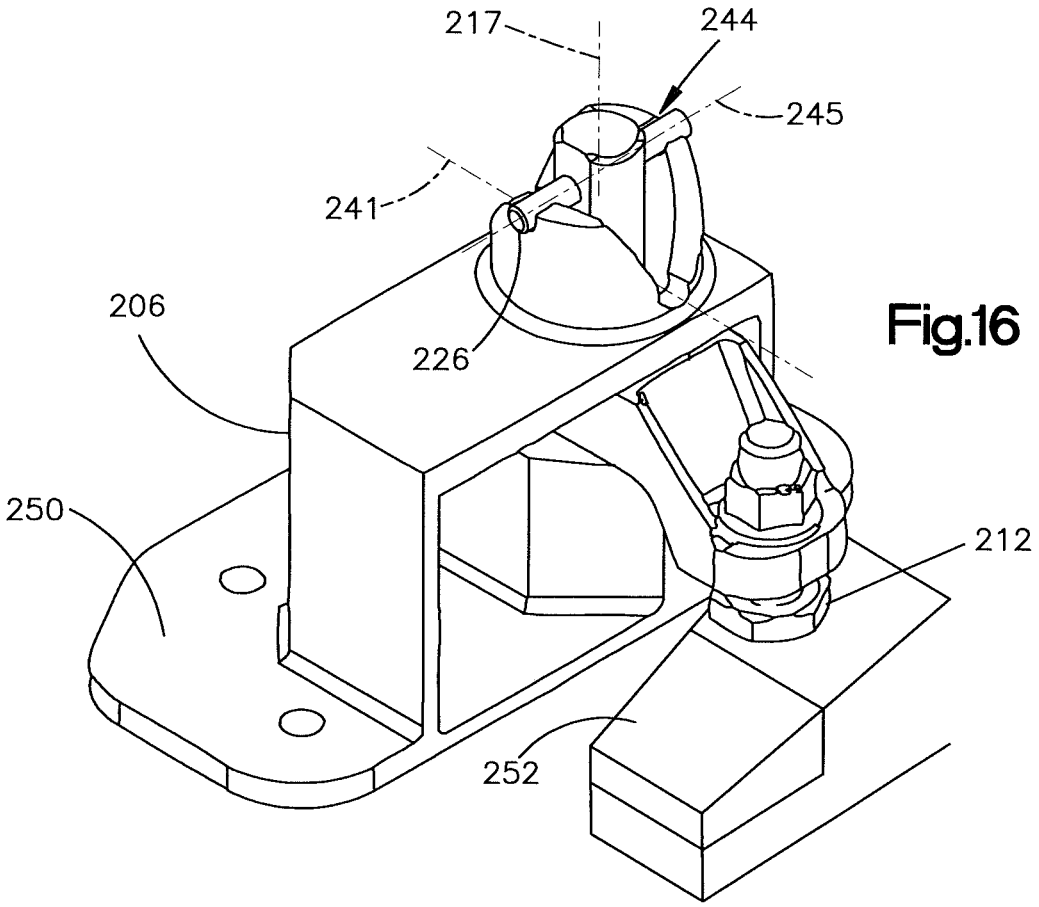
FIG. 16 is a perspective view of the embodiment of FIG. 10, showing parts in different positions.

A user may move the latch member 202 to a latching position, as shown in FIG. 16, by first pushing the shaft 204 axially inward against the bias of the spring 248 until the locator pin 226 is moved inward beyond the locator structure 238 on the body 206. The user may next rotate the shaft 204 90° to move the locator pin 226 into alignment with the second notches 244, and allow the spring 248 to move the shaft 206 back outward until the locator pin 226 rests in the second notches 244. The bolt 212 is then engaged with a bracket on the adjacent panel to secure the panels from movement relative to one another.

When the latch member 202 is moved to the latching position of FIG. 16, the head 220 of the shaft 204 is retracted fully into the body 206. Reversing these movements will move the latch member 204 back out of the latched position, and will move the head 220 back outward of the body 206. The head 220 is thus movable between retracted and extended positions with reference to an outer surface of an aircraft body panel to serve as a visual indicator device for an unlatched condition of a door panel.

Also shown in FIG. 16 is a ramp surface 252 at the bracket on the adjacent panel. The ramp surface 252 may be inclined downward along the path of movement of the bolt 212 from the latching to the unlatched position of the latch member 204. This promotes sliding movement of the bolt 212 downward along the ramp surface 252 under the influence of the spring 248. Such movement can return the latch member 204 to the unlatched position, with actuation of the head 220 as a visual indicator device, if the latch member 204 has not been moved fully to the latching position in which the bolt 212 securely engages the bracket.

In each of the illustrated embodiments of a latch assembly, all parts of the latch assembly, with the exception of a visual indictor device, preferably remain flush with, or recessed from, the adjacent outer surface of the door panel throughout the entire range of movement of the latch member between the lathing and unlatched positions. Additionally, supporting the latch member for movement pivotally about the axis of the shaft provides the latch member with a range of movement in a plane that is parallel to the outer surface, rather than perpendicular to the outer surface, and thereby reduces the depth of the latch assembly relative to the door panel and the opening in the surround panel.

While the methods and forms of apparatus disclosed herein may constitute preferred aspects of the disclosed latch assembly, it is to be understood that the invention is not limited to these precise forms and methods, and that changes may be made therein without departing from the scope of the invention.

What is claimed is:

1. A latch assembly for use with a first structure having an outer surface and a second structure movable relative to the first structure, the latch assembly comprising:

a latch member movable into and out of a latching position securing the second structure to the first structure;

a visual indicator device movable between a retracted position not protruding outward from the outer surface of the first structure and an extended position protruding outward from the outer surface, the visual indicator device having a longitudinal axis and movable longitudinally between the retracted position and the extended position and the latch member movable out of the latching position pivotally about the longitudinal axis of the visual indicator device; and a linkage that is operatively connected between the latch member and the visual indicator device to move the visual indicator device from the retracted position to the extended position under the influence of the latch member when the latch member is moved out of the latching position, the linkage comprising a helical cam and a cam follower engaged between the latch member and the visual indicator device to move the visual indicator device longitudinally upon movement of the latch member pivotally.

2. The latch assembly of claim 1, wherein the visual indicator device is flush with the outer surface of the first structure when the visual indicator device is in the retracted position.

3. The latch assembly of claim 1, wherein the visual indicator device is movable through an aperture in the first structure and is received fully within the aperture when in the retracted position.

4. The latch assembly of claim 1 wherein the linkage further moves the visual indicator device from the extended position to the retracted position upon movement of the latch member into the latching position.

5. The latch assembly of claim 1 wherein the linkage includes a spring-biased over-center mechanism engaged between the latch member and the visual indicator device.

6. The latch assembly of claim 1 wherein the visual indicator device is mounted on the first structure.

7. The latch assembly of claim 1 wherein the latch member is mounted on the first structure.

8. The latch assembly of claim 1 wherein the visual indicator device and the latch member are both mounted on the first structure.

9. A vehicle comprising:

a first vehicle body panel having an outer surface;

a second vehicle body panel movable relative to the first vehicle body panel;

a latch member movable pivotally into and out of a latching position securing the second vehicle body panel to the first vehicle body panel;

a visual indicator device having a longitudinal axis, the visual indicator device being movable longitudinally between a retracted position not protruding outward from the outer surface of the first vehicle body panel and an extended position protruding outward from the outer surface, the latch member moveable out of the latching position pivotally about the longitudinal axis of the visual indicator device; and a mechanism comprising a helical cam and a cam follower engaged between the latch member and the indicator device to move the indicator device longitudinally upon movement of the latch member pivotally, whereby the mechanism moves the indicator device from the retracted position to the extended position under the influence of the latch member when the latch member is moved out of into and out of the latching position.

10. The vehicle of claim 9 wherein the latch member projects transversely from a rotatable shaft, and the indicator device comprises a sleeve received over the shaft.

11. The vehicle of claim 10 wherein the helical cam and cam follower are engaged between the shaft and the sleeve.

12. The vehicle of claim 9 wherein the vehicle is selected from an aircraft, a spacecraft, a land vehicle and a marine vehicle.

13. A method of indicating an unlatched condition of first and second structures that are movable relative to one another, the method comprising:

moving a latch member out of a latching position securing the first and second structures together; and moving a visual indicator device under the influence of the latch member, including moving the visual indicator device relative to an outer surface of the first structure from a non-protruding position not protruding outward from the outward surface of the first structure to a protruding position protruding outward from the outward surface of the first structure under the influence of the latch member when the latch member is moved out of the latching position, the visual indicator device having a longitudinal axis and movable longitudinally between the non-protruding position and the protruding position and the latch member movable out of the latching position pivotally about the longitudinal axis of the visual indicator device, wherein a linkage is operatively connected between the latch member and the visual indicator device to move the visual indicator device from the non-protruding position to the protruding position under the influence of the latch member when the latch member is moved out of the latching position, the linkage comprising a helical cam and a cam follower engaged between the latch member and the visual indicator device to move the visual indicator device longitudinally upon movement of the latch member pivotally.

14. The method of claim 13 wherein moving the visual indicator device under the influence of the latch member further moves the visual indicator device from the protruding position to the non-protruding position upon movement of the latch member into the latching position.

15. The method of claim 13 wherein moving the visual indicator device under the influence of the latch member moves the visual indicator device through an aperture at the outer surface of the first structure.

16. A latch assembly for use with a first structure having an outer surface and a second structure movable relative to the first structure, the latch assembly comprising:

a latch member movable into and out of a latching position securing the second structure to the first structure;

a visual indicator device movable between a retracted position not protruding outward from the outer surface of the first structure and an extended position protruding outward from the outer surface, the visual indicator device having a longitudinal axis and movable longitudinally between the retracted position and the extended position and the latch member movable out of the latching position pivotally about the longitudinal axis of the visual indicator device; and a linkage that is operatively connected between the latch member and the visual indicator device to move the visual indicator device from the retracted position to the extended position under the influence of the latch member when the latch member is moved out of the latching position, wherein the linkage permits the visual indicator device to move longitudinally relative to the latch member, and constrains the visual indicator device to rotate about the longitudinal axis upon movement of the latch member pivotally.

17. The latch assembly of claim 16, further comprising a spring biasing the visual indicator device longitudinally toward the extended position.

* * * * *